US009090438B2

(12) United States Patent
Krebs

(10) Patent No.: US 9,090,438 B2
(45) Date of Patent: Jul. 28, 2015

(54) LOCKING AND BOLTING UNIT

(75) Inventor: Thomas Krebs, Blieskastel (DE)

(73) Assignee: Terex Cranes Germany GmbH (DE)

( * ) Notice: Subject to any disclaimer, the term of this patent is extended or adjusted under 35 U.S.C. 154(b) by 855 days.

(21) Appl. No.: 12/707,737

(22) Filed: Feb. 18, 2010

(65) Prior Publication Data

US 2010/0213154 A1 Aug. 26, 2010

(30) Foreign Application Priority Data

Feb. 20, 2009 (DE) ..... 10 2009 009 944

(51) Int. Cl.
*B66C 23/62* (2006.01)
*B66C 23/70* (2006.01)

(52) U.S. Cl.
CPC ..... *B66C 23/708* (2013.01)

(58) Field of Classification Search
USPC ..... 212/177, 292, 348
See application file for complete search history.

(56) References Cited

U.S. PATENT DOCUMENTS

| | | | | | |
|---|---|---|---|---|---|
| 315,109 | A | * | 4/1885 | Ball | 212/177 |
| 2,083,161 | A | * | 6/1937 | Gilpin | 70/185 |
| 3,269,561 | A | * | 8/1966 | De Ligt | 212/333 |
| 3,426,657 | A | * | 2/1969 | Bimba | 92/255 |
| 3,524,560 | A | * | 8/1970 | Hall | 414/694 |
| 3,559,954 | A | * | 2/1971 | Chambers et al. | 254/106 |
| 3,863,407 | A | * | 2/1975 | Eucken | 52/115 |
| 3,905,279 | A | * | 9/1975 | Yadon | 92/13.8 |
| 3,921,819 | A | * | 11/1975 | Spain | 212/349 |
| 4,111,239 | A | * | 9/1978 | Svaty | 139/438 |
| 4,253,638 | A | * | 3/1981 | Troxell, Jr. | 251/1.3 |
| 4,260,321 | A | * | 4/1981 | Beauchamp et al. | 414/694 |
| 4,324,435 | A | * | 4/1982 | Fischer | 299/37.5 |
| 4,348,007 | A | * | 9/1982 | Malzacher | 254/106 |
| 4,596,415 | A | * | 6/1986 | Blatt | 294/202 |
| 4,663,900 | A | * | 5/1987 | Rehm et al. | 52/115 |
| 4,728,249 | A | * | 3/1988 | Gano | 414/718 |
| 4,784,278 | A | * | 11/1988 | Luscombe | 212/292 |
| 4,954,041 | A | * | 9/1990 | Dahlquist et al. | 414/718 |
| 4,993,564 | A | * | 2/1991 | Blatt | 212/177 |
| 5,395,200 | A | * | 3/1995 | Meier | 414/281 |
| 5,628,416 | A | * | 5/1997 | Frommelt et al. | 212/292 |
| 5,660,495 | A | * | 8/1997 | Atsukawa | 403/377 |
| 5,688,014 | A | * | 11/1997 | Kot | 294/115 |
| 5,733,096 | A | * | 3/1998 | Van Doren et al. | 414/744.3 |

(Continued)

FOREIGN PATENT DOCUMENTS

| | | | | |
|---|---|---|---|---|
| DE | 4018222 | A1 | 12/1991 | |
| DE | 19824672 | A1 * | 12/1998 | B66C 23/693 |

(Continued)

*Primary Examiner* — Emmanuel M Marcelo
*Assistant Examiner* — Michael Gallion
(74) *Attorney, Agent, or Firm* — Cantor Colburn LLP

(57) ABSTRACT

A locking and bolting unit for sections telescoping out of a basic element, in particular sections of a telescoping boom of a mobile crane. The invention involves a locking and bolting unit for sections telescoping out of a basic element, in particular sections of a telescoping boom of a mobile crane, comprising two safety bolts (3) arranged displaceably relative to each other, and an interlocking bolt (5) interacting with a grasper (4). Moreover, the safety bolts (3) and an extension of the grasper (4) constructed as a piston rod (5) are positioned together in a lower housing section vertically displaceable in relation to each other and the piston (6) for the piston rod (5) of the grasper (4) is located in an upper housing part (2) placed on a lower housing part (1).

15 Claims, 3 Drawing Sheets

(56) References Cited

U.S. PATENT DOCUMENTS

| | | | | |
|---|---|---|---|---|
| 5,865,327 | A * | 2/1999 | Johnston | 212/343 |
| 6,062,404 | A * | 5/2000 | Erdmann | 212/292 |
| 6,164,468 | A * | 12/2000 | Erdmann | 212/348 |
| 6,189,712 | B1 * | 2/2001 | Conrad et al. | 212/292 |
| 6,206,213 | B1 * | 3/2001 | Conrad | 212/292 |
| 6,216,895 | B1 * | 4/2001 | Erdmann et al. | 212/292 |
| 6,474,486 | B1 * | 11/2002 | Baraniak | 212/292 |
| 6,520,359 | B2 * | 2/2003 | Richter et al. | 212/292 |
| 6,527,131 | B1 * | 3/2003 | Brockelmann et al. | 212/292 |
| 6,601,719 | B2 * | 8/2003 | Harrington | 212/292 |
| RE39,786 | E * | 8/2007 | Dellach | 403/322.3 |
| 7,353,889 | B1 * | 4/2008 | Gunsaulis et al. | 175/272 |
| 2001/0052506 | A1 * | 12/2001 | Richter et al. | 212/177 |
| 2002/0056693 | A1 * | 5/2002 | Stowasser et al. | 212/292 |
| 2003/0057172 | A1 * | 3/2003 | Harrington | 212/292 |
| 2010/0017027 | A1 * | 1/2010 | Truttmann | 700/245 |

FOREIGN PATENT DOCUMENTS

| | | | | |
|---|---|---|---|---|
| DE | 19926131 | A1 * | 12/2000 | B66C 23/693 |
| DE | 10164601 | A1 | 7/2003 | |
| DE | 19926131 | B4 | 4/2007 | |

* cited by examiner

LOCKING AND BOLTING UNIT

CROSS REFERENCE TO RELATED APPLICATION

This application claims the benefit of German application number 1020090099441 filed Feb. 20, 2009 the contents of which are incorporated herein by reference thereto.

FIELD OF THE INVENTION

The invention involves a locking and bolting unit for sections telescoping out of a basic element, in particular sections of a telescoping boom of a mobile crane comprising two safety bolts arranged displaceably relative to each other and an interlocking bolt interacting with a grasper.

BACKGROUND

A crane with a telescoping boom is known from DE 198 24 672 A1 whose individual sections telescoping in the basic boom after release of the arresting safety bolts can be extended and withdrawn with a one piston-cylinder unit and which are locked in the extended or withdrawn positions by interlocking bolts. The interlocking bolts are connected with the grasper which produces the connection to the drive mechanism.

As can be seen from DE 199 26 131 B4, the activation of the safety bolts often occurs via a lever mechanism.

Such locking and bolting units, abbreviated LBU, are used everywhere where structural elements must undergo translational movement. Applications may include mobile cranes with a telescoping boom, construction cranes with a telescoping mast, windmills which have a telescoping mast, hydraulic platforms, elevators, fork lifts, etc.

Previously known solutions, as already described, always operate directly to implement the desired bolt position with the help of a gear rack or sliding sets, and—detecting the bolt position always occurs directly. It would thus be conceivable that upon the breaking of a gear rack or the breaking of a sliding set that a secure position of the bolting bolt would be detected by the sensor unit.

The present invention is directed to creating a locking and bolting unit which, in contrast to current LBU's, has no intermediately placed components between the "release element" and the "activation element". As a result, there should be a reduction in the number of parts and a reduction in the weight and cost of the component parts.

The goal is the omission of unneeded component parts, like a gear rack, sliding set, spring elements etc. and a reduction of the number of parts (less cost, less weight), as well as the possibility for a direct query of the bolt position. Furthermore, there would be the possibility of reducing the size of the construction of the LBU compared to comparable solutions, but independent of the loading.

SUMMARY

The object is achieved in the invention using a locking and bolting unit for sections telescoping out of a basic element, in particular sections of a telescoping boom of a mobile crane comprising two safety bolts arranged displaceably relative to each other and a safety bolt interacting with a grasper, characterized in that the safety bolts and an extension of the grasper constructed as a piston rod are positioned together in a lower housing section vertically displaceable in relation to each other, and that the piston for the piston rod of the grasper is located in an upper housing part placed on a lower housing part.

The above features and advantages, and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of the embodiments, the detailed description referring to the drawings in which.

DESCRIPTION OF THE EMBODIMENTS

Figure 1:
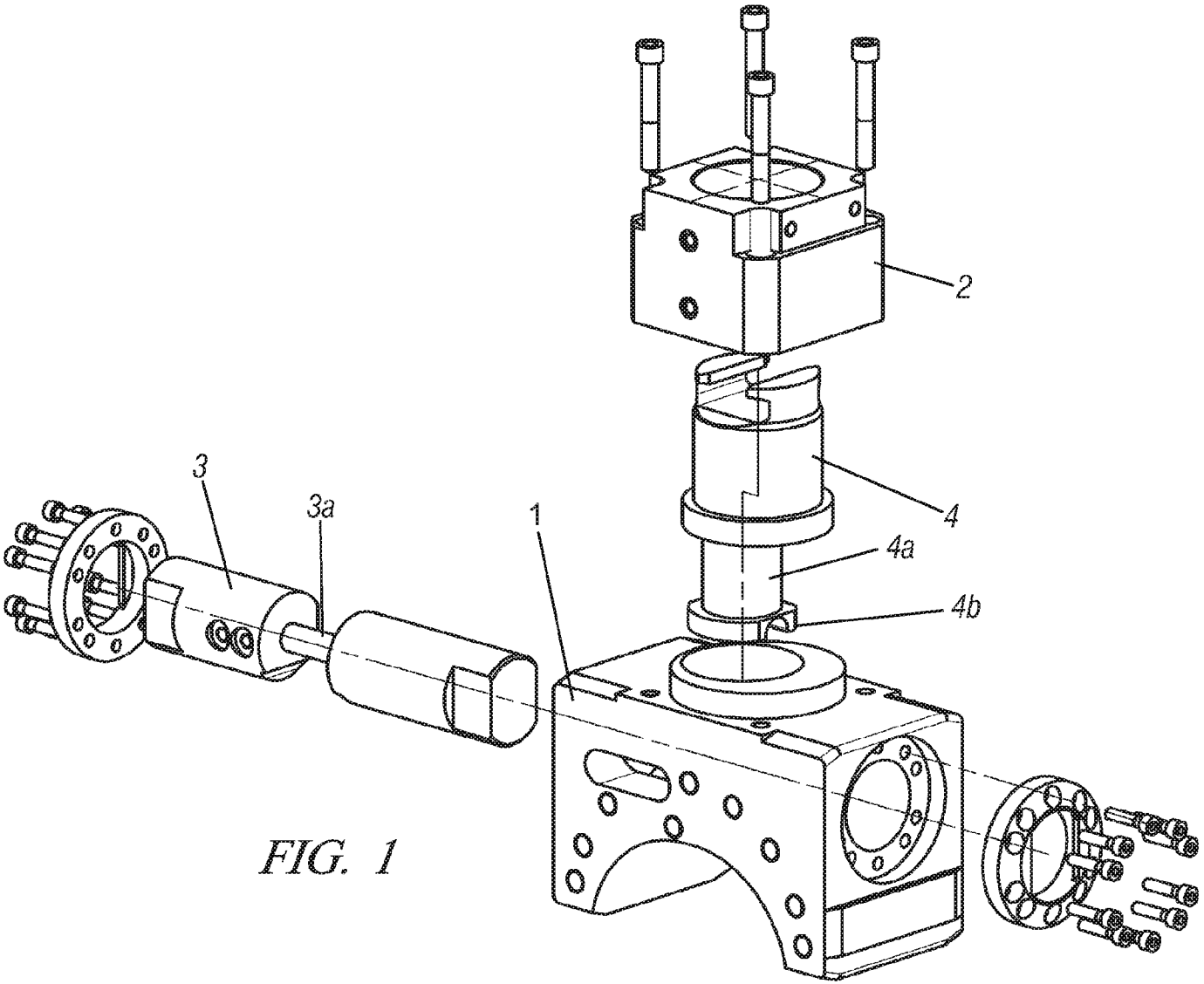
FIG. 1: shows the individual component parts of the locking and bolting unit.

In an exemplary embodiment, the hydraulic release element is simultaneously a mechanical activation element, and thus the elimination of interposed component parts (slide set, gear rack, etc.) is possible. Further advantages include the absolute intrinsic mechanical safety by the selection of the shape, no hydraulic/electric logic in the form of valves/switches, or other items.

Thus a telescope system can be made available which can be used with several telescope booms (large cross sections to very small cross section) as well as in connection with a building-block principle.

By means of eccentricity, i.e., the geometry of the grasper cylinder, the underlying locking cylinder can be extended to the same length on both sides.

The locking and bolting unit of the invention thus consists as it were of only 3 component parts, namely the housing, the hydraulic/pneumatic safety bolt (locking cylinder), and the hydraulic/pneumatic grasper (bolting cylinder).

The invention permits optimal use of the available construction space, since only those component parts are used which serve the indirect functions (locking, bolting). The grasper is positioned vertical to the axis of the locking cylinder. The control of the functional elements can occur hydraulically or pneumatically. The functional unit (LBU) is activated hydraulically/pneumatically but is mechanically locked for inherent safety. No additional activation elements are necessary. Omitted are sliding sets/gear racks/springs.

The number of necessary components is limited to those most needed, i.e., the number of possible sources of error were reduced to a minimum.

Intrinsic safety is present; when the unit is unlocked, it is simultaneously bolted because of the mechanical logic. The axis of the safety bolt is eccentrically fitted to the telescope cylinder longitudinal axis because of a reduction of the construction space. The acquisition of the bolt position occurs indirectly by initiators at the processed switching edges on the locking cylinder and the grasper.

Two hydraulic/pneumatic supply lines are necessary on the locking cylinder or on the housing upper part.

No hydraulic logic is necessary. The functional unit (LBU) can be placed at any location in the longitudinal direction of the telescope cylinder, but preferably at the start of the part that displaces.

The locking and bolting unit of the invention consists of a housing lower part 1 and a housing upper part 2 secured thereto. Both safety bolts 3 are mounted displaceably in the lower housing part 1, whereby the right and the left bolt are connected by means of a piston rod 3*a*. The piston associated with the piston rod 3*a* which is located in one of the bolts is not represented here.

By means of this arrangement, the two safety bolts 3 can be pushed apart or together relative to each other. The piston rod 3*a* exhibits—as can be seen in the drawing—a smaller diameter than the safety bolt itself.

Figure 5:
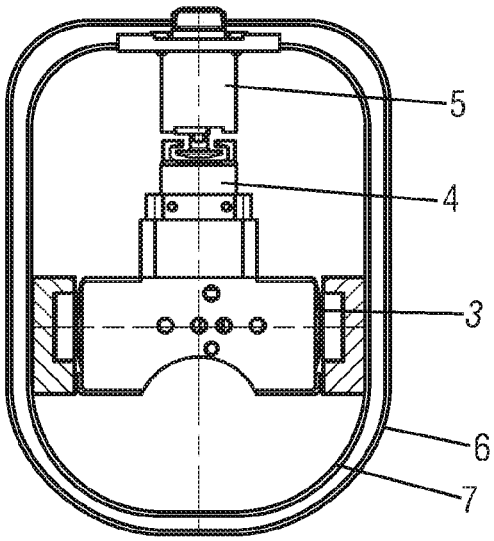
FIGS. 5-7: show the corresponding depictions but viewed in the cross-section of a boom section.
Figure 6:
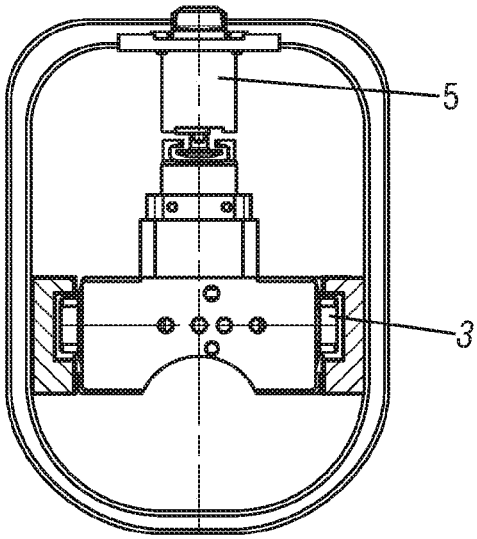

The housing upper part 2 is set on the housing lower part 1 and into it is guided a piston rod 4*a* which constitutes an extension of the grasper 4. With respect to its longitudinal axis the longitudinal axis of the piston rod 4*a* is eccentric and features a recess 4*b* on its free end. The grasper 4 protrudes from the housing upper part 2. The upper free end of the grasper 4 is, as shown in FIGS. 5-7, brought into contact in the usual manner with an interlocking bolt 5.

Figure 2:
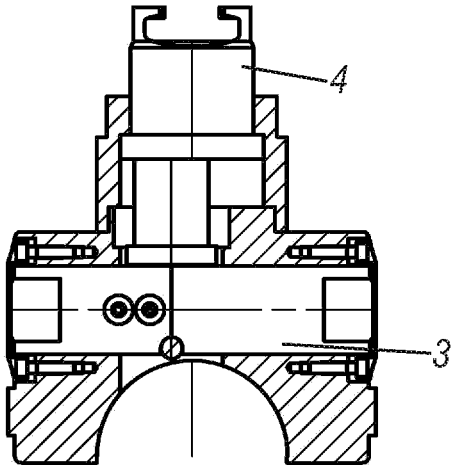
FIGS. 2-4: show the individual positions of the grasper or the safety bolt.
Figure 3:
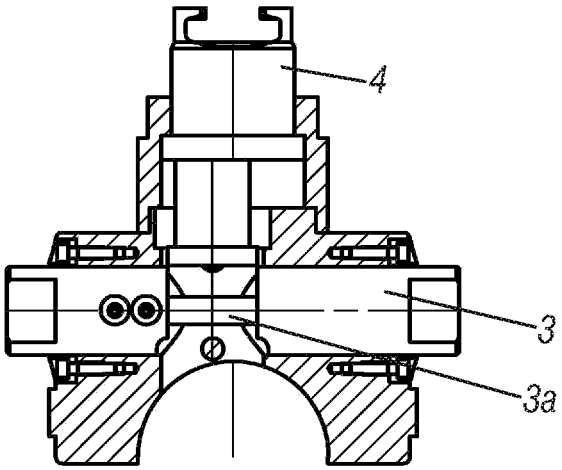
Figure 4:
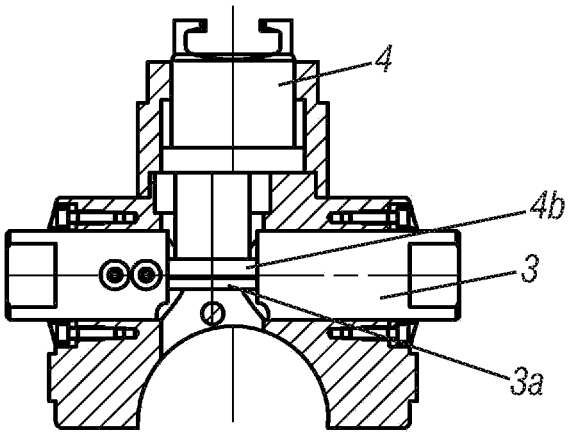

As shown in FIGS. 2-3, the dimensions of the lower part of the piston rod of the grasper with the recess 4*b*, the piston rod 3*a*, and the separation of the safety bolts 3 are dimensioned such that, when they are pushed apart, the piston rod 4*a* with the recess 4*b* in the intermediate area between the safety bolts can be lowered and thus partially encompass the piston rod 3*a*, FIG. 4.

Figure 7:
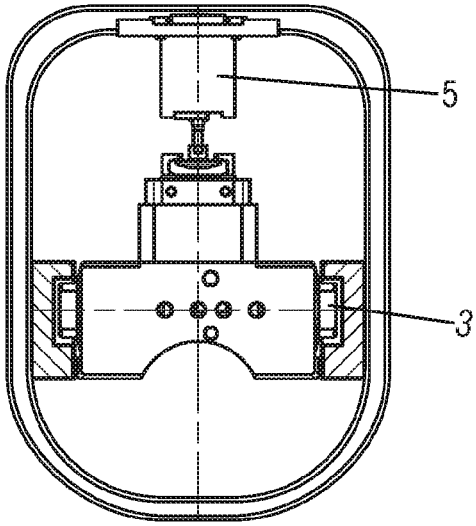

In this lowered position the grasper 4 unlocks the interlocking bolt 5 connected to it, as is shown in FIGS. 4 and 7.

There thus result the conditions shown in FIGS. 2-4 and 5-7, namely the unlocked position of the safety bolts 3 in the bolted position of the interlocking bolt 5 (FIG. 2 and FIG. 5), the locked position of the safety bolts 3 and the bolted position of the interlocking bolt 5 (FIG. 3 and FIG. 6) and the locked position of the safety bolts 3 with an unbolted position of the interlocking bolt 5 (FIG. 4 and FIG. 7). The sections of the telescope boom are then designated as 6 and 7 in FIGS. 5 to 7.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

The invention claimed is:

1. Locking and bolting unit for sections of a telescoping boom of a mobile crane comprising two safety bolts arranged along a common axis displaceably relative to each other and an interlocking bolt interacting with a grasper, wherein the safety bolts and an extension of the grasper constructed as a first piston rod together are arranged in a lower housing section and displaceable in relation to each other, and in that a piston for the first piston rod of the grasper is located in an upper housing part placed on a lower housing part, and wherein a second piston rod is coupled between the safety bolts and extends along the common axis between the safety bolts, and the safety bolts are movable toward and away from each other along the common axis of the second piston rod, wherein the second piston rod is connected to at least one of the safety bolts and guided in another safety bolt of the two safety bolts.

2. Locking and bolting unit according to claim 1, wherein the first piston rod is constructed as an extension of the grasper and runs in an eccentric manner to the grasper axis and has a recess on a free end of the first piston rod, and the first piston rod can be lowered between the pushed-apart safety bolts and encompass the second piston rod with the recess in order to unlock the interlocking bolt.

3. Locking and bolting unit according to claim 2, wherein control of the first and second piston rods occurs hydraulically or pneumatically.

4. Locking and bolting unit for sections of a telescoping boom of a mobile crane comprising two safety bolts along a common axis displaceably relative to each other and an interlocking bolt interacting with a grasper, wherein the safety bolts and an extension of the grasper constructed as a first piston rod together are arranged in a lower housing section, the safety bolts and the first piston rod displaceable in relation to each other, and in that a piston for the first piston rod of the grasper is located in an upper housing section placed on the lower housing section, and wherein a second piston rod extends along the common axis between the safety bolts and the safety bolts are movable toward and away from each other along a direction of the common axis of the second piston rod, and wherein the first piston rod constructed as an extension of the grasper runs in an eccentric manner to a grasper axis and has a recess on a free end of the first piston rod, and the first piston rod can be lowered between the pushed-apart safety bolts and encompass the second piston rod with the recess in order to unlock the interlocking bolts, wherein the second piston rod is connected to one of the safety bolts and is guided in another of the safety bolts.

5. A locking and bolting unit for sections of a telescopic boom, the unit comprising:

a pair of safety bolts coupled by a first piston rod, the pair of safety bolts and the first piston rod extending along a common axis, the safety bolts displaceable relative to each other such that the safety bolts are movable toward and away from each other along the common axis; and a grasper having a second piston rod extending therefrom, wherein the grasper is configured to engage an interlocking bolt to move the interlocking bolt between a bolted position and an unbolted position, wherein the first piston rod is coupled to a piston, the piston disposed in one of the safety bolts of the pair of safety bolts.

6. The locking and bolting unit of claim 5, wherein the common axis of the first piston rod extends transversely to a longitudinal axis of sections of the telescopic boom.

7. The locking and bolting unit of claim 5, further comprising an upper housing and a lower housing, wherein the grasper is arranged in the upper housing and the pair of safety bolts, the first piston rod, and the second piston rod are arranged in the lower housing.

8. The locking and bolting unit of claim 5, wherein the second piston rod comprises a recess on a free end, the second piston rod configured to be lowered between the pair of safety bolts such that the recess at least partially surrounds the first piston rod to facilitate moving the interlocking bolt to the unbolted position.

9. The locking and bolting unit of claim 8, wherein the grasper comprises a second axis, and the second piston rod is oriented eccentrically to the second axis.

10. The locking and bolting unit of claim 5, further comprising a telescope cylinder coupled to the locking and bolting unit, the telescope cylinder extending along a telescope cylinder longitudinal axis.

11. The locking and bolting unit of claim 5, wherein the interlocking bolt extends along an interlocking bolt axis that is orthogonal to the common axis.

12. The locking and bolting unit of claim 11, wherein in the unbolted position the interlocking bolt is configured to extend through only a first boom section of the telescopic boom, and in the bolted position, the interlocking bolt is configured to extend through the first boom section and a second boom section of the telescopic boom to lock the first boom section from movement relative to the second boom section.

13. The locking and bolting unit of claim 5, wherein the first piston rod includes a first end and a second end, and the pair of safety bolts comprises a first safety bolt and a second safety bolt, wherein the piston rod first end is coupled to an end of the first safety bolt, and the piston rod second end is coupled to an end of the second safety bolt.

14. The locking and bolting unit of claim 7, wherein the upper housing is directly coupled to the lower housing, the upper housing and the lower housing configured to be disposed within an innermost boom section of the telescopic boom.

15. The locking and bolting unit of claim 5, wherein the first piston rod has a diameter smaller than a diameter of each safety bolt of the pair of safety bolts.

* * * * *